US009027909B1

(12) United States Patent
Peyton et al.

(10) Patent No.: US 9,027,909 B1
(45) Date of Patent: May 12, 2015

(54) RACKABLE SCREWLESS FENCING SYSTEM

(71) Applicant: Origin Point Brands, LLC, North Charleston, SC (US)

(72) Inventors: Basil C. Peyton, Duluth, GA (US); Paul Brent Gelegotis, Charleston, SC (US); Robert A. Prezzano, Wadmalaw Island, SC (US)

(73) Assignee: Origin Point Brands, LLC, North Charleston, SC (US)

( * ) Notice: Subject to any disclaimer, the term of this patent is extended or adjusted under 35 U.S.C. 154(b) by 0 days.

(21) Appl. No.: 13/902,044

(22) Filed: May 24, 2013

(51) Int. Cl.
*E04H 17/14* (2006.01)

(52) U.S. Cl.
CPC ..... *E04H 17/1434* (2013.01)

(58) Field of Classification Search
USPC ..... 256/21, 22, 65.01, 65.02, 65.08, 65.11, 256/65.12
See application file for complete search history.

(56) References Cited

U.S. PATENT DOCUMENTS

| | | | | | |
|---|---|---|---|---|---|
| 4,373,826 | A | * | 2/1983 | Inamoto et al. | 403/14 |
| 4,821,481 | A | * | 4/1989 | Woodman | 52/664 |
| 5,443,244 | A | | 8/1995 | Gibbs | |
| 5,454,548 | A | | 10/1995 | Moore | |
| 5,556,079 | A | | 9/1996 | West | |
| 5,649,688 | A | | 7/1997 | Baker | |
| 5,660,378 | A | * | 8/1997 | Schall | 256/65.12 |
| 5,873,564 | A | | 2/1999 | Bisch | |
| 5,882,001 | A | | 3/1999 | Reinbold | |
| 5,913,508 | A | | 6/1999 | Eades | |
| 6,029,954 | A | | 2/2000 | Murdaca | |
| 6,135,425 | A | * | 10/2000 | Platt | 256/66 |
| 6,176,053 | B1 | | 1/2001 | St. Germain | |
| 6,375,166 | B1 | * | 4/2002 | Schall et al. | 256/65.08 |
| 6,460,829 | B1 | | 10/2002 | Forbis et al. | |
| D465,856 | S | | 11/2002 | Givens et al. | |
| 6,631,887 | B1 | | 10/2003 | Walmsley | |
| 6,682,056 | B1 | | 1/2004 | West | |

(Continued)

FOREIGN PATENT DOCUMENTS

WO WO2007-119039 A1 10/2007

OTHER PUBLICATIONS

U.S. Appl. No. 61/151,122, filed Feb. 9, 2009.

*Primary Examiner* — Michael P Ferguson
*Assistant Examiner* — Daniel Wiley
(74) *Attorney, Agent, or Firm* — Tim St. Clair; Nexsen Pruet, LLC

(57) ABSTRACT

A fencing system comprises a rail, a picket, and a picket carrier. The rail may include an upper contour, a first wall depending down from the upper contour, a second wall depending down from the upper contour and opposite the first wall, and a keeper disposed on the first wall under the upper contour. The picket may define therein an opening. The picket carrier may be elongated and may include a first side and an opposite second side, and a profile extending from the second side that defines a length along the picket carrier and may further define a cross-section. The cross-section may include an extension proximate to the second side and a holder distal to the second side. A first relief may be defined along the length and a second relief defined along the length, the second relief disposed apart from the first relief, with the holder of the profile that resides between the first and second reliefs extending into the opening. The picket carrier may reside stationery within the rail between the first and second walls in between the keeper and the upper contour. The picket may be pivotable relative to the rail.

20 Claims, 7 Drawing Sheets

(56) References Cited

U.S. PATENT DOCUMENTS

| | | | | |
|---|---|---|---|---|
| 6,752,385 | B2 * | 6/2004 | Zen et al. | 256/65.01 |
| 6,752,386 | B1 | 6/2004 | Bundy | |
| 6,824,123 | B2 | 11/2004 | Larsen et al. | |
| 6,863,265 | B2 | 3/2005 | Perry et al. | |
| 6,969,051 | B1 | 11/2005 | Gibbs | |
| 7,152,849 | B2 * | 12/2006 | Graber | 256/22 |
| 7,384,025 | B2 * | 6/2008 | Lo | 256/65.08 |
| 7,543,802 | B2 | 6/2009 | Petta et al. | |
| 7,635,115 | B2 | 12/2009 | Lehmann | |
| 7,677,535 | B1 | 3/2010 | Lo | |
| 7,942,384 | B1 | 5/2011 | Gibbs | |
| 7,980,534 | B1 | 7/2011 | Gibbs et al. | |
| 8,056,235 | B1 | 11/2011 | Briggs et al. | |
| 8,104,744 | B2 | 1/2012 | Brownbill | |
| 8,413,332 | B2 | 4/2013 | Duffy et al. | |
| 8,413,965 | B2 | 4/2013 | Duffy et al. | |
| 2004/0099854 | A1 | 5/2004 | Walmsley | |
| 2007/0158630 | A1 | 7/2007 | Lo | |
| 2008/0121857 | A1 | 5/2008 | Lo | |
| 2009/0026431 | A1 | 1/2009 | Tremblay et al. | |
| 2009/0166599 | A1 * | 7/2009 | Lo | 256/65.01 |
| 2010/0044662 | A1 | 2/2010 | Walmsley | |
| 2010/0200827 | A1 * | 8/2010 | Duffy et al. | 256/67 |
| 2010/0252793 | A1 * | 10/2010 | Ash | 256/65.02 |
| 2010/0264388 | A1 | 10/2010 | Duffy et al. | |
| 2010/0276653 | A1 | 11/2010 | Gibbs | |
| 2010/0288988 | A2 | 11/2010 | Gibbs et al. | |
| 2011/0001105 | A1 | 1/2011 | Lo | |
| 2011/0042637 | A1 * | 2/2011 | Howard et al. | 256/22 |
| 2011/0127482 | A1 | 6/2011 | Lo | |
| 2011/0155982 | A1 | 6/2011 | Duffy et al. | |
| 2011/0233499 | A1 * | 9/2011 | Stinson | 256/65.01 |
| 2013/0264532 | A1 * | 10/2013 | Goodman | 256/65.08 |

* cited by examiner

Fig. 2
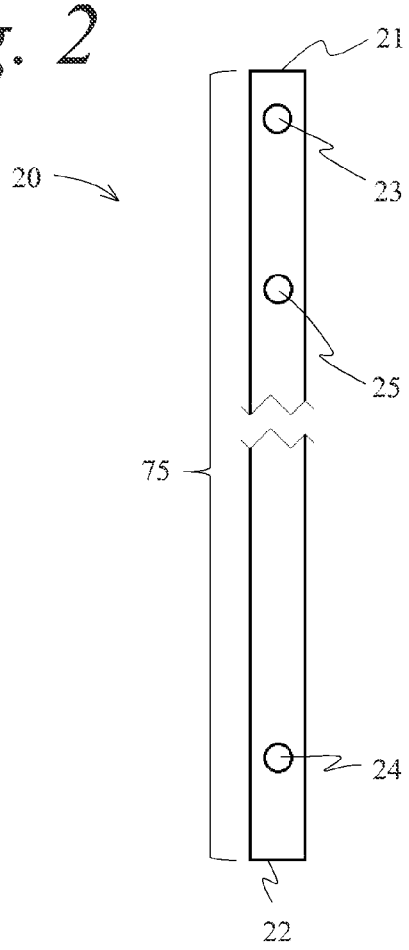
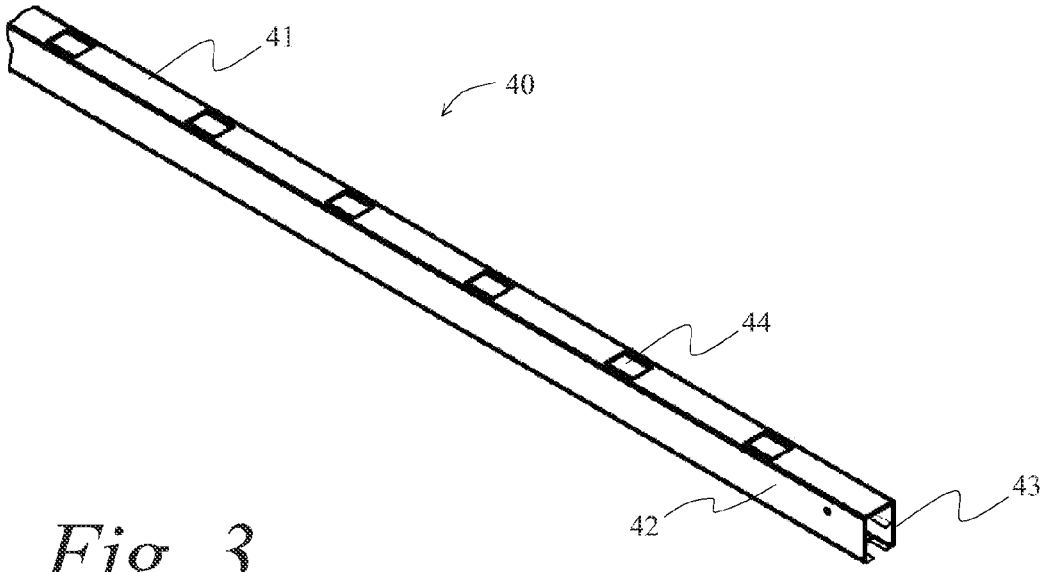
Fig. 3

RACKABLE SCREWLESS FENCING SYSTEM

TECHNICAL FIELD

The present invention relates to rackable fencing, and more particularly, to screwless rackable fencing with simplified components including a rail carrier.

BACKGROUND

The terrain across which fencing may be desired is often inclined, yet users typically prefer that the fence pickets be oriented vertical to the horizon, for aesthetic reasons, regardless of the slope of the terrain.

Accounting for such topography may require time-consuming custom fence fabrication on-site. It is more desirable in many applications, though, for fencing to be pre-assembled off-site, as pre-assembly simplifies installation and reduces costs as a result of economies of scale.

One technique for using pre-assembled fencing on inclined terrain is to "stair-step" pre-assembled fencing panels, such that the pickets remain vertical but the rails remain horizontal—the height of adjacent panels are adjusted relative to each other to match the terrain even though the respective rails of the adjacent panels may not thereafter match. The practice is less-than-optimal, however, as gaps are left between the bottom of each fencing panel and the inclined terrain beneath it.

Most preferably, rackable pre-assembled fencing would be adjustable to match a range of inclines, as a range of inclines can be encountered even upon a single fencing installation at a particular site and certainly between several fencing sites.

Modularity of pre-assembled fencing panels is also desirable. Inasmuch as plans may be altered during installation of fencing, or additional fencing may be discovered to be desirable after insulation of an initial run, or later replacement may be desired of a section of fencing damaged after installation, modularity of design would allow for easy and aesthetically matching and consistent final results.

Optimally, fencing should be of simplified manufacture with a minimum of components and with easily-manufactured components.

The fencing products previously known do not ideally address the foregoing concerns.

SUMMARY OF THE INVENTION

A rackable, screwless fencing system comprising components that have been optimized is disclosed. As revealed in the following description and the appended figures, this invention discovers a simplified, functional design.

In accordance with certain aspects of certain embodiments of the present technology, a fencing system is provided that comprises a rail, a picket, and a picket carrier. The rail may include an upper contour, a first wall depending down from the upper contour, and a second wall depending down from the upper contour and opposite the first wall. The picket may define therein an opening. The picket carrier may be elongated and may include a first side and an opposite second side, and a profile extending from the second side. The profile may define a first length along the picket carrier. A first relief may be defined along the first length and a second relief may be defined along the first length that is disposed apart from the first relief, with the profile that resides beside the first and second reliefs extending into the opening defined in the picket. The picket carrier may be engaged with the rail between the first and second walls.

In accordance with additional aspects of other embodiments of the present technology, the fencing system may include a picket that is rotatable relative to the rail. In some embodiments, the picket carrier may define a second length and a rail may define a third length, with the third length being greater than the second length. In particular examples, the rail length may be at least twice the picket carrier length. In accordance with other aspects of other embodiments of the present technology, the rail may include an aperture defined through the upper contour and the picket may extend through the aperture. Certain examples provide that the rail includes a compression rib that abuts against the picket carrier.

In accordance with other aspects of other embodiments of the present technology, a method of fabricating a fencing system is provided. The method includes the steps of providing a rail, the rail including an upper contour, a first wall depending down from the upper contour and a second wall depending down from the upper contour and opposite the first wall. Additionally, a picket may be provided, the picket defining a first length and creating an opening along the first length. Further, a picket carrier may be provided, the picket carrier being elongated and including a first side and an opposite second side, a top end and a bottom end, and defining a second length, with a profile extending from the second side, the profile defining a third length along the second length. Additionally, the step of creating a first relief along the third length may be included. Further, a second relief may be included along the third length, the second relief spaced apart from the first relief. Further, the profile remaining between the first and second reliefs may be inserted into the opening to form a picket assembly and the picket assembly may be inserted into the rail between the first wall and the second wall.

In accordance with additional aspects of other embodiments of the present technology, the rail may include an aperture defined through the upper contour and the additional step of inserting the picket through the aperture may be included.

In accordance with still further aspects of other embodiments of the present technology, the step of providing a picket carrier may include extruding the picket carrier.

In accordance with yet still further aspects of other embodiments of the present technology, a fencing system made in accordance with the foregoing steps may be provided, wherein the picket, further, is rotatable relative to the rail. In certain examples, the picket carrier may not slide relative to the rail when the picket is rotated relative to the rail. Still further, in other applications, the rail may include a first keeper disposed on the first wall under the upper contour and a second keeper disposed on the second wall under the upper contour. In particular embodiments, the picket carrier may be in contact with both the first keeper and the upper contour. In some applications, the picket may be in frictional engagement with at least one of the profile, the picket carrier, the first keeper, and the second keeper.

In accordance with additional aspects of other embodiments of the present technology, a fencing system is provided that comprises a rail, a picket, and a picket carrier. The rail may include an upper contour, a first wall depending down from the upper contour, a second wall depending down from the upper contour and opposite the first wall, and a keeper disposed on the first wall under the upper contour. The picket may define therein an opening. The picket carrier may be elongated and may include a first side and an opposite second side, and a profile extending from the second side that defines a length along the picket carrier and may further define a cross-section. The cross-section may include an extension proximate to the second side and a holder distal to the second side. A first relief may be defined along the length and a second relief defined along the length, the second relief disposed apart from the first relief, with the holder of the profile that resides between the first and second reliefs extending into the opening. The picket carrier may reside stationery within the rail between the first and second walls in between the keeper and the upper contour. Further, the picket may be pivotable relative to the rail. In accordance yet with additional aspects of other embodiments of the present technology, the rail may define a second length along its longitude and the picket carrier may define a third length along its longitude, the second length being greater than the third length. With still further aspects of other embodiments of the present technology, the rail may include a second keeper disposed on the second wall under the upper contour. In particular applications, the picket may be in frictional engagement with at least one of the profile, the picket carrier, the first keeper, and the second keeper. In some applications, the picket carrier may abut both the first keeper and the upper contour. For some embodiments, the holder may include a first arm and a second arm, the first arm residing between the extension and the upper contour and the second arm residing between the extension and the first keeper. Additional embodiments provide that the rail includes a compression rib that abuts against the picket carrier.

So configured, fencing system is disclosed with components that are simplified yet functional to provide a rackable fencing system.

The foregoing description sets forth in broad detail certain features of the present technology so that the detailed description herein may be better understood and so that the present contributions to the art from this invention may be better appreciated. Additional features of the invention may be disclosed below.

It should be further appreciated that modifications and variations to the invention specifically illustrated or disclosed herein may be practiced in various embodiments and uses of the invention without departing from the spirit and scope of the subject matter. Additional objects and advantages of the present invention are set forth herein or will be apparent to those of ordinary skill in the art from the detailed description herein. It should be further appreciated that modifications and variations to the specifically illustrated, referred, and discussed features and elements hereof may be practiced in various embodiments and uses of the invention without departing from the spirit and scope of the subject matter. Variations may include, but are not admitted to, substitution of equivalent means, features, or steps for those illustrated, referenced, or discussed, and the functional, operational, or positional reversal of various parts, features, steps or the like. Still further, it is to be understood that different embodiments, as well as presently preferred embodiments, of the present subject matter may include various combinations or configurations of presently the disclosed features, steps, or elements, or their equivalents, (including combinations of features, parts, or steps, or configurations, not expressly shown in the figures or stated in the detailed description of such figures).

BRIEF DESCRIPTION OF THE DRAWINGS

The details of the present invention, both as to its structure and as to its functionality, can be understood with reference to the accompanying figures. It should be noted that these figures are not necessarily to scale in all instances.

FIG. 2 is a broken view of a picket in accordance with certain aspects of the present invention;

FIG. 3 is a perspective view of a rail in accordance with certain aspects of the present invention;

DETAILED DESCRIPTION

Figure 1:
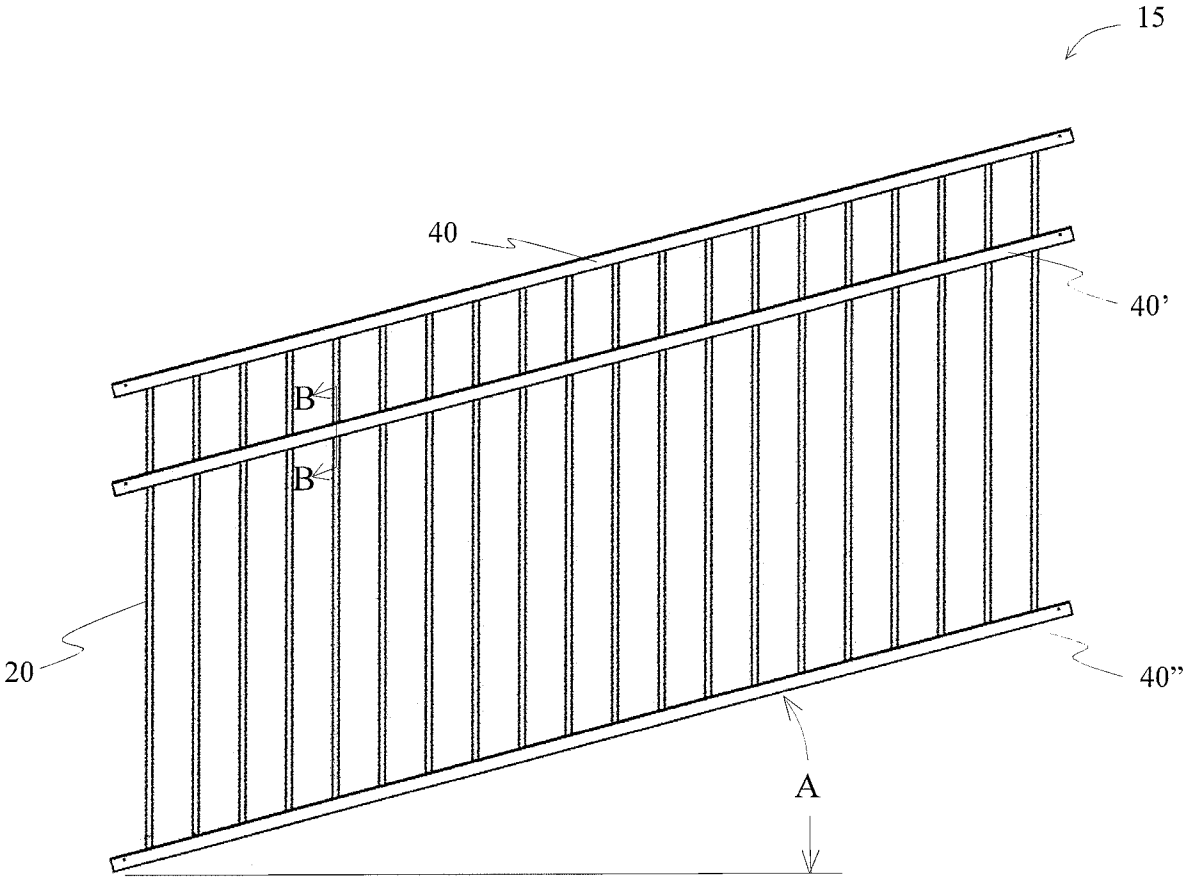
FIG. 1 is an elevation view of the disclosed fencing system in accordance with certain aspects of the present invention.

Reference will now be made in detail to the presently preferred embodiments of the invention, one or more examples of which are illustrated in the drawings. Each example is provided by way of explanation of the invention and not meant as a limitation of the invention. For example, features illustrated or described as part of one embodiment can be used in another embodiment to yield a yet still further embodiment. It is intended that the present application include such modifications and variations as come within the scope and spirit of the invention. The embodiments described below are not exhaustive nor do they limit the invention to the precise forms disclosed. Rather, the described embodiments are chosen so that others skilled in the art to which this invention pertains may appreciate and understand the principles and practices of the present invention.

A fencing system 15 is provided. Fencing system 15 may include a picket 20, a rail 40, and a picket carrier 60.

Picket 20 is an elongated member defining a first length 75. In certain embodiments, picket 20 can be fabricated of metal, such as steel or aluminum. In particular embodiments, picket 20 may have a square or rectangular cross-section. Picket 20 may include an upper end 21 and an opposed lower end 22. Proximate to upper end 21, an upper opening 23 may be defined in one wall of picket 20. Similarly, proximate to lower end 22, a lower opening 24 may be defined in picket 20. As will be more fully described below, in fencing system 15 that include two rails 40, upper opening 23 and lower opening 24 may be used for attaching the picket 22 to two rails 40. In fencing systems 15 that include a third rail 40, an intermediate opening 25 may be defined in picket 20 between upper opening 23 and lower opening 24. Openings 23, 24, and/or 25 may be round, square, or of other desirable shapes.

Rail 40 may be fabricated of metal, such as aluminum or steel. In cross-section rail 40 may be understood to include an upper contour 41, a first wall 42 depending down from upper contour 41, and a second wall 43 depending down from upper contour 41 and opposite first wall 42. When used at the top of a fencing system 15, rail 40 may include an upper contour 41 that is uninterrupted—defining no openings therethrough. However, when used as a lower rail 40 in a fencing system 15, or as an intermediate rail 40 disposed between upper and lower rails 40, rail 40 may include one or more apertures 44 defined through upper contour 41, for receipt therethrough of a picket 20. In some embodiments, rail 40 may include a first keeper 47 disposed on first wall 42, first keeper 47 residing below upper contour 41. In particular applications, rail 40 may include a second keeper 48, disposed on second wall 43 under upper contour 41.

In particular embodiments, rail 40 may also include a first compression rib 45, projecting from first wall 42 toward second wall 43 and residing between first keeper 47 and upper contour 41. In other applications, rail 40 may also include a second compression rib 46, disposed on second wall 43 toward first wall 42, and residing between second keeper 48 and upper contour 41.

Picket carrier 60 may include a top edge 61 and a bottom edge 62. Picket carrier 60 may be further understood to have a first side 63 and a second side 64. A profile 65 may extend from second side 64. In cross-section, profile 65 may include a base 66 and an extension 67. A holder comprised of first arm 68 and second arm 69 may reside on extension 67 opposite base 66. In certain embodiments, picket carrier 60 may include a first toe 70 proximate to bottom edge 62. In particular applications, a second toe 71 may also reside on picket carrier 60, proximate to bottom edge 62.

Picket carrier 60 may include a first relief 72 and a second relief 73 along profile 65. First relief 72 and second relief 73 may be disposed apart from each other, such that a portion of profile 65 resides between first relief 72 and second relief 73.

In practice, the portion of profile 65 residing between first relief 72 and second relief 73 may extend into an opening, such as opening 23, in picket 20. With picket carrier 60 and picket 20 thereby engaged together, the two may be interfitted within a rail 40. Advantageously, picket 20 is rotatable relative to rail 40, as allowed by picket carrier 60 being inter-fitted with picket 20 by extending a portion of profile 65 into an opening, such as upper opening 23, of picket 20. Furthermore, once assembled, picket carrier 60 may be stationery relative to rail 40.

In particular applications, picket carrier 60 may define a second length 76 and rail 40 may define a third length 77, the third length of rail 40 being greater than the second length of picket carrier 60. In particular applications, the third length of rail 40 may be at least twice the second length of picket carrier 60.

Picket 20 may be in frictional engagement with at least one of the profile 65, picket carrier 60, first keeper 47, and second keeper 48. So configured, then, though picket 20 is rotatable relative to rail 40, such frictional engagement will allow the user to rotate the picket(s) 20 relative to the rail(s) 40 in a panel of fencing fabricated in accordance with fencing system 15 and for the panel thereafter to hold such an angular orientation unless and until further rotation is induced by the user.

In particular applications, picket carrier 60 may abut the first keeper 47 of a rail 40 as well as the upper contour 41 of such rail 40.

It has been found with the present invention that two factors may contribute to a particularly useful and stable configuration for individual applications of fencing system 15: the inclusion of a compression rib 45, 46 and the tapering of picket carrier 60 in cross-section (larger at bottom edge 62 and smaller at top edge 61). So configured and appropriately dimensioned, system 15 may be assembled easily by reason of the tapered cross-section of picket carrier 60, the smaller dimension of top edge 61 lending itself to insertion into rail 40, yet, when assembled, compression rib 45, 46, as the case may be, assists providing an integrated, sound, rattle-proof assembly because compression rib 45, 46 pushes against the tapering of picket carrier 60.

Turning to FIG. 1, a fencing system 15 is depicted. Fencing system 15, by reason of the invention disclosed herein, has been racked to an angle of A relative to horizontal. Such racking of fencing system 15 is advantageous, in that fencing system 15 may be used on non-level ground, yet still maintain the verticality of pickets 20. The particular embodiment depicted in FIG. 1 includes a first rail 40, a second rail 40', and a third rail 40". In certain other applications (not shown), only a top rail 40 and a bottom rail 40" may be used, as determined by the user.

FIG. 2 shows a picket 20. In the particular embodiment depicted, picket 20 includes an upper opening 23, a lower opening 24, and an intermediate opening 25. For fencing systems 15 that only have an upper rail 40 and a lower rail 40", intermediate opening 25 would be unnecessary and not included. Openings 23, 24, and 25 are shown as round, but only for illustrative purposes, as each and all may be square or of any desirable shape.

FIG. 3 illustrates an embodiment of a rail 40. As shown therein, rail 40 in this embodiment includes multiple apertures 44 for receipt therethrough of multiple pickets 20. Apertures 44 may of any shape to match or complement the cross-sectional shape of pickets 20. As depicted therein, rail 40 includes upper contour 41, first wall 42, and second wall 43.

Figure 4:
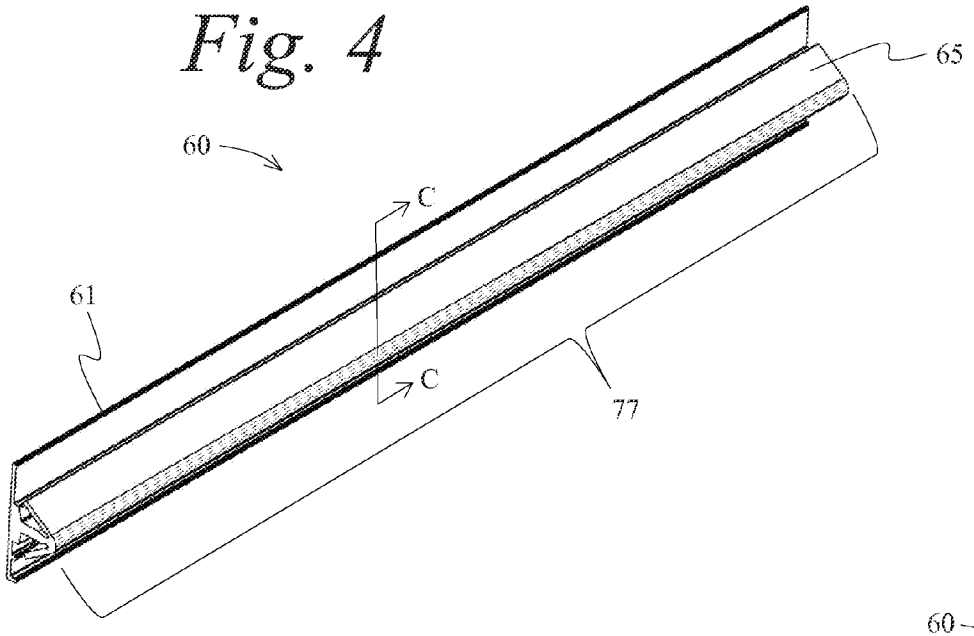
FIG. 4 is a perspective view of a picket carrier in accordance with certain aspects of the present invention.
Figure 5:
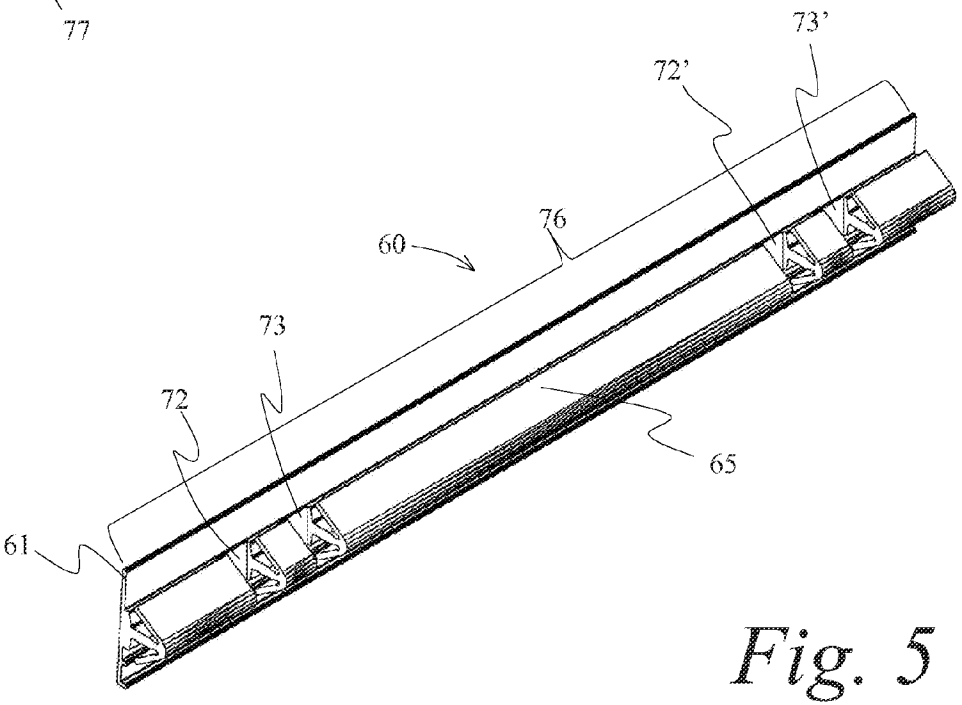
FIG. 5 is a perspective view of a picket carrier in accordance with certain aspects of the present invention.

FIG. 4 illustrates an embodiment of a picket carrier 60 As shown therein, picket carrier 60 includes a top edge 61 and a profile 65. In forming the picket carrier 60 for use with fencing system 15, FIG. 5 shows inclusion of a first relief 72 and a second relief 73, in spaced-apart relation one to another, leaving a portion of profile 65 between first relief 72 and second relief 73. As illustrated in FIG. 5, a third relief 72' and a fourth relief 73' have likewise been formed through profile 65, for use in interfitting with a second picket 20.

Figure 6:
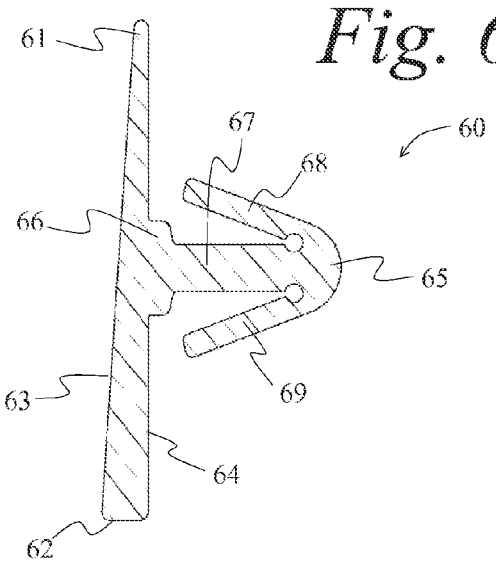
FIG. 6 is a cross-sectional view of a picket carrier in accordance with certain aspects of the present invention, taken at C-C in FIG. 4.
Figure 7:
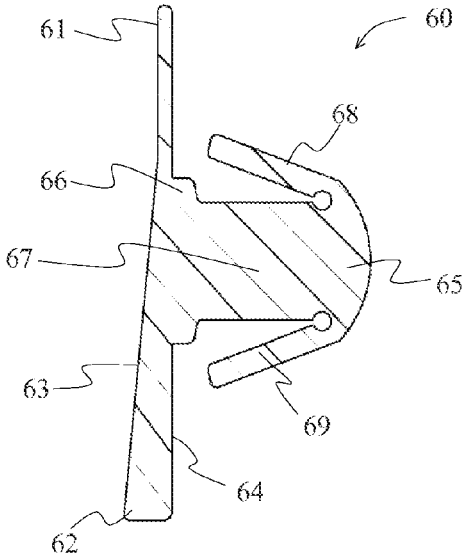
FIG. 7 is a cross-sectional view of a picket carrier in accordance with certain aspects of the present invention, taken at C-C in FIG. 4.
Figure 8:
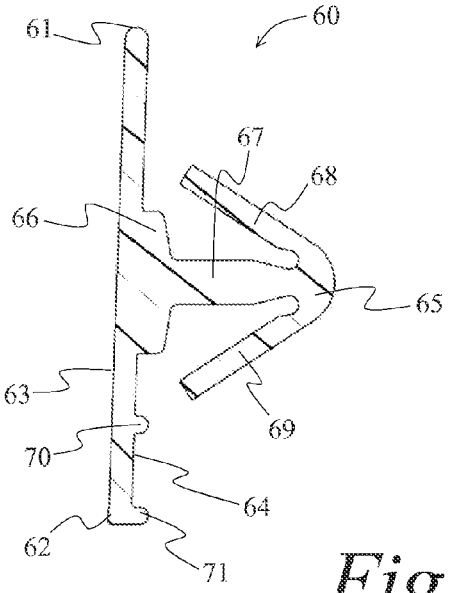
FIG. 8 is a cross-sectional view of a picket carrier in accordance with certain aspects of the present invention, taken at C-C in FIG. 4.

FIGS. 6, 7 and 8 are cross-sectional views of different embodiments of picket carrier 60. In FIG. 6, top edge 61 is narrower than bottom edge 62, such that picket carrier 60 is wedge-like, which may aid assembly of fencing system 15. As illustrated therein, profile 65 projects from second side 64. Profile 65 includes base 66, extension 67, and first arm 68 and second arm 69 together forming a holder structure. FIG. 6, for example, depicts a particular embodiment of a picket carrier 60 that has been found to be one factor contributing to a particularly useful and stable configuration for individual applications of fencing system 15: the tapering of picket carrier 60 in cross-section (larger at bottom edge 62 and smaller at top edge 61). So configured, system 15 may be assembled more easily by reason of the tapered cross-section of picket carrier 60, the smaller dimension of top edge 61 lending itself to insertion into rail 40, yet, when assembled, compression rib 45, 46, as the case may be, assisting in providing an integrated, sound, rattle-proof assembly because compression rib 45, 46 pushes against the tapering of picket carrier 60.

FIG. 7 illustrates a second embodiment of a picket carrier 60. As provided therein, extension 67 is of greater dimension than that depicted in FIG. 6, as is base 66, which may be advantageous in certain applications.

FIG. 8 illustrates a third embodiment of picket carrier 60. As shown therein, a first toe 70 and a second 71 have been included near bottom edge 62 of picket carrier 60. Base 66 is larger in the embodiment depicted in FIG. 8 than in the embodiment depicted in FIG. 6, which may be useful in certain applications.

Picket carrier 60 may be an extruded member. For some applications, it has been found advantage to fabricate picket 60 by extruding plastic and thereafter cutting plural first reliefs 72 and second reliefs 73 across profile 65 from top-to-bottom. In one embodiment, first arm 68 and second arm 69 are resilient, and appropriately sized, such that they can be compressed toward each other as they are urged through a picket opening, such as upper opening 23, then resiliently expand back to a their respective original positions to as to attach picket carrier 60 to a picket 20. As illustrated in FIGS. 6, 7, and 8, extension 67 and base 66 may each be sized differently for specific circumstances; however, both extension 67 and base 66 are sized relative to the dimension of upper opening 23, lower opening 24, or intermediate opening 25, as the case may be, so as to allow picket 20 to rotate upon profile 65 once picket carrier 60 has been attached to a picket 20 and also once picket carrier 60 and picket 20 have been attached to a rail 40. Additionally, it has been disclosed above that first relief 72 and second relief 73 are in spaced apart relation, with a portion of profile 65 residing between them. The spacing between first relief 72 and second relief 73 is predetermined such that, relative to the dimension of upper opening 23, lower opening 24, or intermediate opening 25, as the case may be, picket 20 may rotate upon profile 65 once picket carrier 60 has been attached to a picket 20 and also once picket carrier 60 and picket 20 have been attached to a rail 40. Further, the respective widths of first relief 72 and second relief 73 may be such that, once the portion of profile 65 between first relief 72 and second relief 73 has been inserted into an opening, such as upper opening 23, picket 20 may reside against second side 64 of picket carrier 60.

Figure 9:
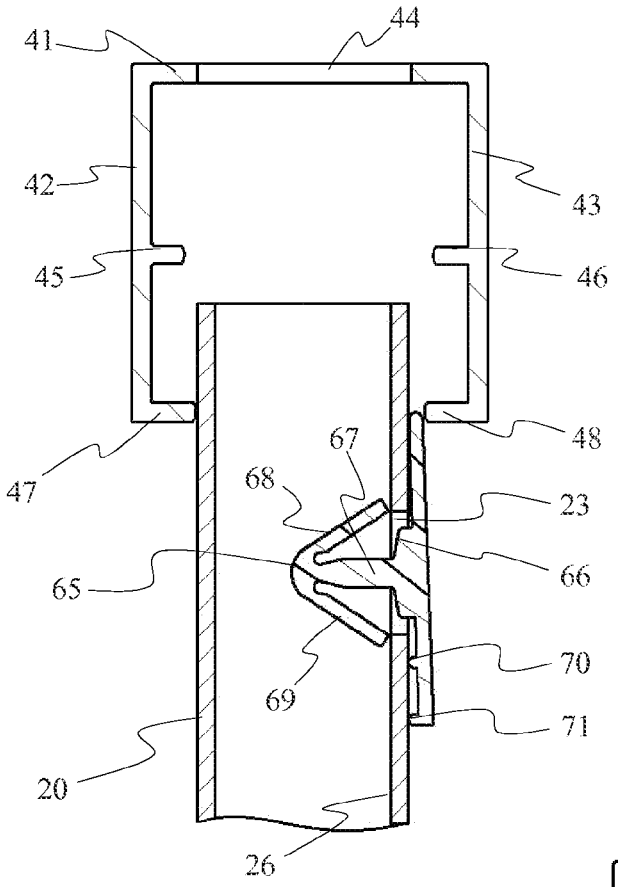
FIG. 9 is a cross-sectional view of a fencing system in accordance with certain aspects of the present invention, taken at B-B in FIG. 1.
Figure 10:
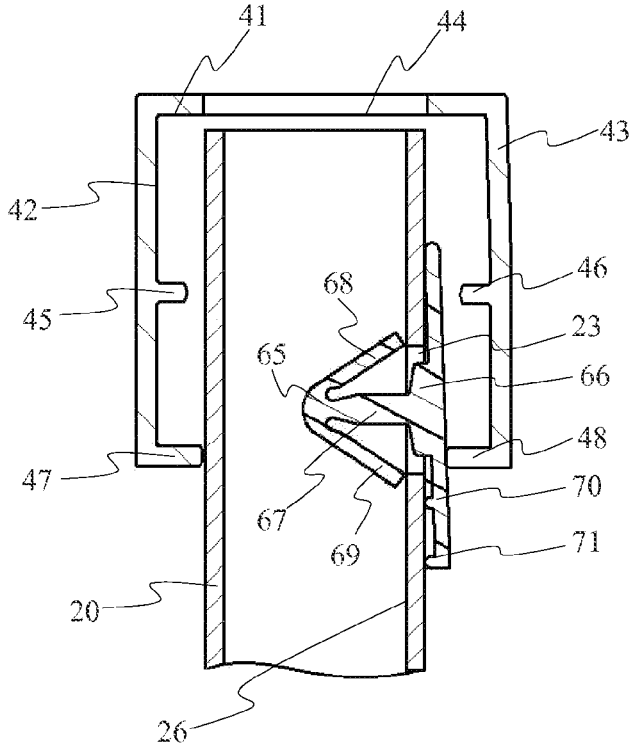
FIG. 10 is a cross-sectional view of a fencing system in accordance with certain aspects of the present invention, taken at B-B in FIG. 1.
Figure 11:
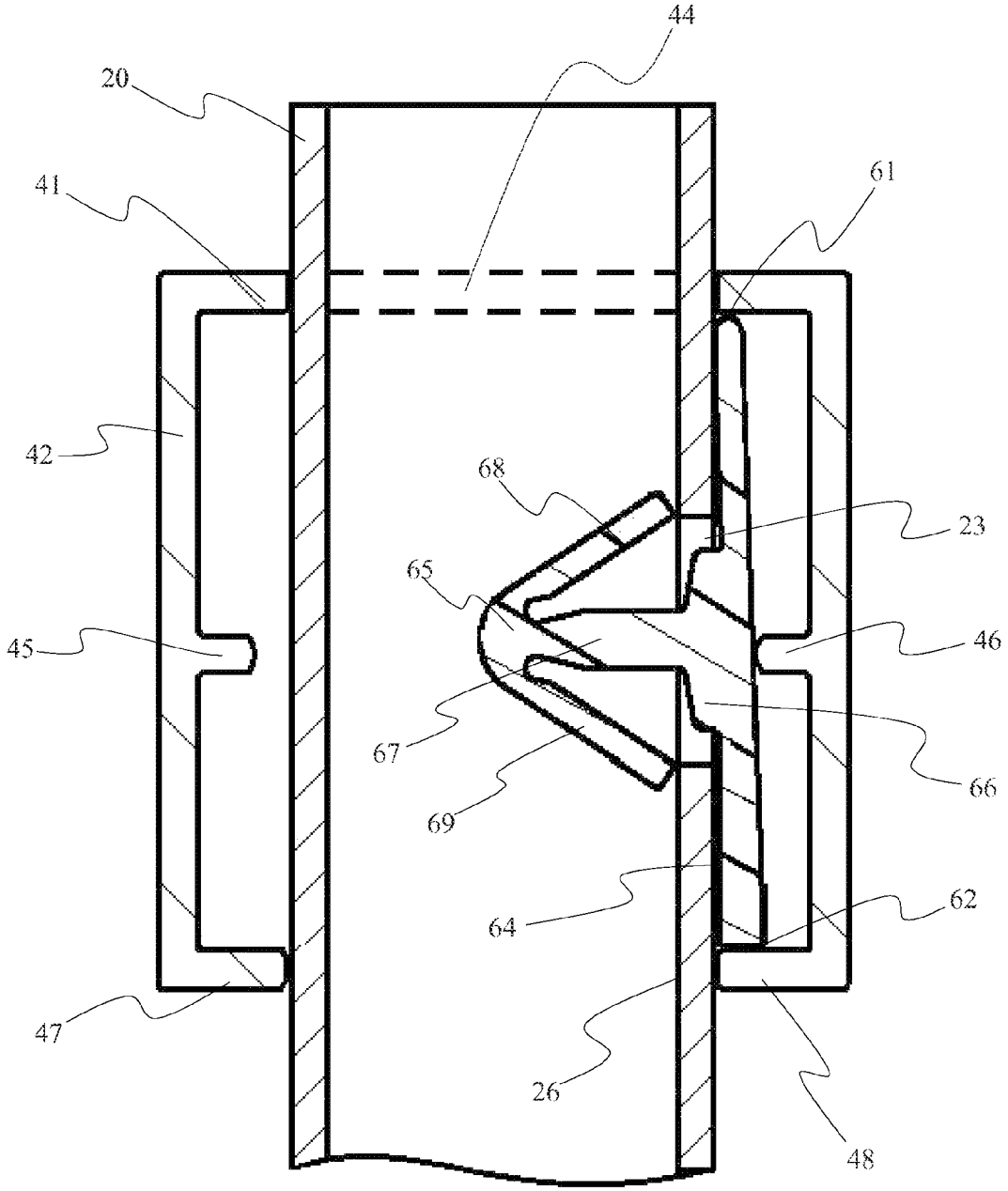
FIG. 11 is a cross-sectional view of a fencing system in accordance with certain aspects of the present invention, taken at B-B in FIG. 1.

FIGS. 9, 10 and 11 illustrate fabrication of a fencing system 15. As shown in FIG. 9, picket carrier 60 has been inter-fitted into an opening 23 of a picket 20. First arm 68 and second arm 69, resilient in nature, have spread after profile 65 was inserted in opening 23, so as to reside against interior surface 26 of picket 20 and thereby prevent picket carrier 60 from being removed from picket 20. With picket 20 and picket carrier 60 so assembled together to form a picket assembly, the picket assembly may be inserted into rail 40 between first keeper 47 and second keeper 48. As illustrated, for example in FIG. 10, second wall 43 of rail 40 may be urged away from first wall 42 as the picket 20 together with picket carrier 60 are urged into rail 40. Once bottom edge 62 of picket carrier 60 clears second keeper 48 during insertion, second wall 43 will resiliently return to its normal position, thereby capturing picket carrier 60 within rail 40. More specifically, in the embodiment depicted in FIG. 11, top edge 61 of picket carrier 60 abuts against upper contour 41 of rail 40, and bottom edge 62 of picket carrier 60 abuts against second keeper 48 of second wall 43 of rail 40 with picket carrier 63 thereby captured within rail 40 and, with picket 20 thereby attached to picket carrier 60, picket 20 is attached to rail 40.

It may be seen in FIG. 11 that the relative sizing of base 66 of picket carrier 60 and upper opening 23 in picket 20 is such that picket 20 may rotate upon picket carrier 60 relative to rail 40.

In the embodiment depicted in FIG. 11, a second compression rib 46 has been included, which is sized to press against picket carrier 60 once fencing system 15 is assembled, further securing picket carrier 60 within picket 20 and thereby picket 20 within rail 40. In the particular embodiment shown in FIG. 11, an opposite first compression rib 45 has likewise been included, such that a cross section of rail 40 is symmetrical about a vertical axis, which allows for more rapid assembly of fencing system 15 and, in practical terms, prevents mis-assembly of fencing system 15.

Figure 12:
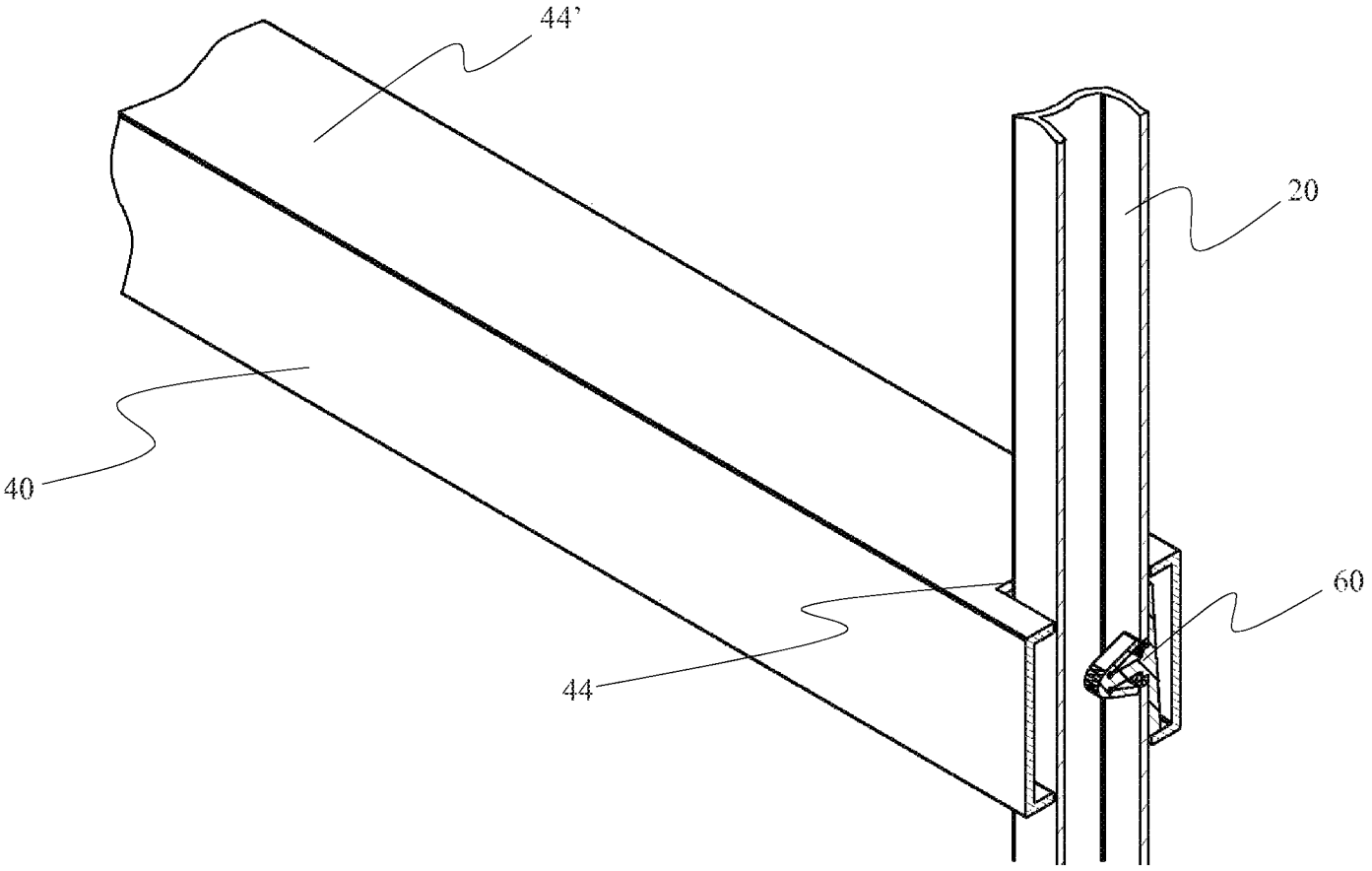
FIG. 12 is a cross-sectional view of a fencing system in accordance with certain aspects of the present invention, taken at B-B in FIG. 1.

FIG. 12 is perspective view of the assembled fencing system 15 illustrated in cross-section in FIG. 11.

In certain embodiments of system 15 as described herein, it has been found that the interfitting of picket carrier 60 into rail 40, carrying pickets 20, results in a system 15 in which picket carrier 60 does not move or slide relative to rail 40 as system 15 is racked. The absence of movement of picket carrier 60 relative to rail 40 during racking has been further found to be desirable in certain application as resulting in a system 15 with the absence of rattling (in inclement weather, upon touch by a user, and the like), a more solid and trustworthy assembly by consumers, and a more accurate "fit" of components that is valued by end-users.

While the particular fencing system 15 described herein is fully capable of attaining the objects of this invention, it is to be understood that it is the presently preferred embodiment of the present technology and is most representative of the subject matter that is broadly contemplated by the present invention. It is to be further understood that the scope of the present invention fully encompasses other embodiments that may become obvious to those skilled in the art it is intended that the present invention include such modification and variations as come within the scope of the appended claims and their equivalents, in which reference to an element in the singular is not intended to mean "one and only one" unless explicitly says stated, but rather "one or more."

The invention claimed is:

1. A fencing system, comprising:

a rail, the rail including:

an upper contour, a first wall depending down from the upper contour, and a second wall depending down from the upper contour and opposite the first wall;

a picket, the picket defining therein an opening; and a picket carrier, the picket carrier being elongated and including:

a first side and an opposite second side;

an elongate profile extending from the second side, the profile defining a uniform cross-section along a length of the picket carrier, the profile including:

an extension protruding from the second side, and at least one resilient arm formed at a distal end of the extension;

a first relief forming a first cut-out of the profile; and a second relief forming a second cut-out of the profile, the second relief disposed apart from the first relief;

the portion of the profile residing between the first and second reliefs comprising a first profile portion, said first profile portion extending into the opening of the picket such that:

at least a portion of the second side of the picket carrier abuts an outer surface of the picket adjacent the opening;

the at least one resilient arm engages an inner surface of the picket adjacent the opening, thereby preventing removal of the picket carrier from the picket; and the first and second reliefs surround opposing side surfaces of the picket; and wherein the rail is positioned on the picket carrier such that:

at least a portion of the first or second wall of the rail engages the first side of the picket carrier.

2. The fencing system of claim 1, wherein the first and second reliefs are sized such that the picket is rotatable relative to the rail.

3. The fencing system of claim 1, wherein the first and second reliefs are sized such that the picket carrier is stationary relative to the rail.

4. The fencing system of claim 1, wherein the rail is longer than the picket carrier.

5. The fencing system of claim 4, wherein the rail is at least twice as long as the picket carrier.

6. A method of fabricating a fencing system, comprising the steps of:

providing a rail, the rail including an upper contour, a first wall depending down from the upper contour, and a second wall depending down from the upper contour and opposite the first wall, providing a picket, the picket comprising an opening therethrough, providing an extruded picket carrier, the picket carrier being elongated and including:

a first side and an opposite second side, a top end and a bottom end; and an elongate profile extending from the second side, the profile defining a uniform cross-section along a length of the picket carrier, the profile including: an extension protruding from the second side, and at least one resilient arm formed at a distal end of the extension;

cutting a first relief from the profile;

cutting a second relief from the profile, the second relief spaced apart from the first relief so as to form a first profile portion between the reliefs;

inserting the first profile portion into the opening to form a picket assembly, whereby at least a portion of the second side of the picket carrier abuts an outer surface of the picket adjacent the opening, the at least one resilient arm engages an inner surface of the picket adjacent the opening, thereby preventing removal of the picket carrier from the picket, and, the first and second reliefs surround opposing side surfaces of the picket; and inserting the picket assembly into the rail between the first wall and the second wall such that at least a portion of the first or second wall engages the first side of the picket carrier.

7. The method of claim 6, wherein the rail includes an aperture defined through the upper contour, and including the further step of inserting the picket through the aperture.

8. A fencing system made in accordance with the method of claim 6 and wherein the first and second reliefs are sized such that the picket is rotatable relative to the rail.

9. The fencing system of claim 8, wherein the picket carrier does not slide relative to the rail when the picket is rotated relative to the rail.

10. The fencing system of claim 8, wherein the rail further includes a first keeper disposed on the first wall under the upper contour and a second keeper disposed on the second wall under the upper contour.

11. The fencing system of claim 8, wherein the picket carrier is in contact with both the first keeper and the upper contour.

12. The fencing system of claim 8, wherein the picket is in frictional engagement with at least one of the profile, the picket carrier, the first keeper, and the second keeper.

13. The fencing system of claim 1, wherein:

the system further includes a second picket defining therein an opening;

the profile further includes third and fourth reliefs forming third and fourth cut-outs of the profile down to the second side of the picket carrier, such that a second profile portion is defined between the third and fourth reliefs, the second profile portion extending into the opening of the second picket; and the first wall of the rail includes a keeper disposed on an inner surface of the first wall under the upper contour, wherein the keeper engages a lower edge of the picket carrier.

14. The fencing system of claim 13, wherein the rail is longer than the picket carrier.

15. The fencing system of claim 13, wherein the rail includes a second keeper disposed on the second wall under the upper contour.

16. The fencing system of claim 15, wherein the first picket is in frictional engagement with at least one of the profile, the picket carrier, the first keeper, and the second keeper.

17. The fencing system of claim 13, wherein the picket carrier abuts both the first keeper and the upper contour.

18. The fencing system of claim 13, wherein the rail includes a compression rib that abuts against the first side of the picket carrier.

19. The fencing system of claim 1, wherein the cross-section of the profile further includes a base proximate to the second side, the extension extending outward from the base, and the at least one resilient arm extending inward from the extension towards the second side.

20. The fencing system of claim 19, wherein the profile of the picket carrier further includes a second resilient arm extending inward from the extension towards the second side, the first resilient arm extending towards the upper contour and the second resilient arm extending away from the upper contour.

* * * * *